US012339051B2

(12) United States Patent
Naik et al.

(10) Patent No.: US 12,339,051 B2
(45) Date of Patent: Jun. 24, 2025

(54) REFRIGERATOR WITH A THERMALLY CONDUCTIVE COMPONENT WITH HEATER FOR ICE MAKER

(71) Applicant: Midea Group Co., Ltd., Foshan (CN)

(72) Inventors: Vinayak Naik, Louisville, KY (US); Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/717,793

(22) Filed: Apr. 11, 2022

(65) Prior Publication Data

US 2023/0324097 A1 Oct. 12, 2023

(51) Int. Cl.
*F25C 5/08* (2006.01)
*F25C 1/243* (2018.01)

(52) U.S. Cl.
CPC ..... *F25C 5/08* (2013.01); *F25C 1/243* (2013.01)

(58) Field of Classification Search
CPC ..... F25C 5/08; F25C 1/243
USPC ..... 62/71
See application file for complete search history.

(56) References Cited

U.S. PATENT DOCUMENTS 1,852,064 A * 4/1932 Rosenberg ..... F25C 1/24 62/344
1,977,608 A * 10/1934 Blystone ..... F25C 1/24 62/350
2,035,679 A * 3/1936 Thompson ..... F25C 5/08 392/338
2,433,210 A * 12/1947 Gits ..... A23G 9/221 D15/90
3,214,128 A * 10/1965 Beck ..... F25C 1/243 D7/672
3,393,531 A 7/1968 Parr
3,581,516 A * 6/1971 Buchser ..... F25C 1/04 222/56
3,864,933 A * 2/1975 Bright ..... F25C 1/04 62/344

(Continued)

FOREIGN PATENT DOCUMENTS

CN 1532484 A 9/2004
DE 102017104727 A1 * 9/2018

(Continued)

OTHER PUBLICATIONS

JP-5972506-B1, machine translation (Year: 2024).*

(Continued)

*Primary Examiner* — Eric S Ruppert
*Assistant Examiner* — Kirstin U Oswald
(74) *Attorney, Agent, or Firm* — Gray Ice Higdon

(57) ABSTRACT

A refrigerator includes a cabinet with one or more food compartments and one or more doors closing the food compartments and an ice maker located in the cabinet to produce ice. The ice maker includes a mold body for forming ice, the mold body having multiple cups, where each cup has an opening for receiving water to be frozen within the cup. The ice maker further includes a thermally conductive component located near a bottom surface of the cups. The thermally conductive component includes at least one heater that provides heat to the plurality of cups, so that the thermally conductive can distribute heat and facilitate a release of ice from the plurality of cups.

19 Claims, 6 Drawing Sheets

(56) References Cited

U.S. PATENT DOCUMENTS

| | | | | | |
|---|---|---|---|---|---|
| 3,898,860 | A * | 8/1975 | Shepherd | F25D 21/002 | 62/155 |
| 3,952,539 | A * | 4/1976 | Hanson | F25C 1/18 | 62/351 |
| 4,942,742 | A | 7/1990 | Burruel | | |
| 5,056,321 | A | 10/1991 | Patrick | | |
| 5,408,844 | A * | 4/1995 | Stokes | F25C 5/08 | 249/79 |
| 5,582,754 | A * | 12/1996 | Smith | F25C 1/24 | 219/521 |
| 5,992,167 | A * | 11/1999 | Hill | F25C 1/04 | 62/347 |
| 6,308,518 | B1 * | 10/2001 | Hunter | F25B 21/02 | 62/3.6 |
| 6,658,869 | B1 | 12/2003 | Thornbrough | | |
| 6,951,113 | B1 | 10/2005 | Adamski | | |
| 7,143,588 | B2 * | 12/2006 | Cole | F25C 1/04 | 62/347 |
| 7,629,558 | B2 | 12/2009 | Petrenko | | |
| 8,099,975 | B2 | 1/2012 | Rafalovich et al. | | |
| 8,371,133 | B2 | 2/2013 | Kim et al. | | |
| 9,012,811 | B2 | 4/2015 | White | | |
| 9,746,229 | B2 | 8/2017 | Visin et al. | | |
| 10,598,420 | B2 | 3/2020 | Woo et al. | | |
| 11,105,547 | B2 | 8/2021 | Song et al. | | |
| 11,112,160 | B2 | 9/2021 | Hong et al. | | |
| 2003/0155467 | A1 * | 8/2003 | Petrenko | B64D 15/22 | 244/134 R |
| 2007/0101753 | A1 * | 5/2007 | Broadbent | F25B 39/02 | 62/349 |
| 2009/0025401 | A1 * | 1/2009 | Heger | F25C 1/10 | 62/73 |
| 2009/0165492 | A1 | 7/2009 | Wilson et al. | | |
| 2009/0211267 | A1 * | 8/2009 | Kim | F25C 1/08 | 62/157 |
| 2009/0223230 | A1 * | 9/2009 | Kim | F25C 1/08 | 62/73 |
| 2011/0094254 | A1 | 4/2011 | Kim | | |
| 2012/0318003 | A1 * | 12/2012 | Kim | F25C 5/08 | 62/340 |
| 2013/0239594 | A1 * | 9/2013 | Lin | F25C 5/08 | 62/73 |
| 2016/0201965 | A1 * | 7/2016 | Abeygunawardana | F25C 5/08 | 62/349 |
| 2017/0191722 | A1 * | 7/2017 | Bertolini | F25C 5/22 | |
| 2017/0307278 | A1 | 10/2017 | Chandran et al. | | |
| 2019/0011167 | A1 | 1/2019 | Larson et al. | | |
| 2019/0226750 | A1 | 7/2019 | Kang et al. | | |
| 2020/0064043 | A1 | 2/2020 | Larson et al. | | |
| 2020/0158408 | A1 | 5/2020 | Kim et al. | | |
| 2020/0158410 | A1 | 5/2020 | Kim et al. | | |
| 2020/0400359 | A1 * | 12/2020 | Junge | F25C 5/14 | |
| 2021/0080165 | A1 | 3/2021 | Bertolini et al. | | |
| 2021/0325100 | A1 * | 10/2021 | Smith | F25C 1/04 | |

FOREIGN PATENT DOCUMENTS

| | | | | |
|---|---|---|---|---|
| JP | 2002090073 | A * | 3/2002 | |
| JP | 5972506 | B1 * | 8/2016 | C10G 1/10 |
| JP | 6861790 | B2 * | 4/2021 | A45D 20/08 |
| KR | 20060098052 | A | 9/2006 | |

OTHER PUBLICATIONS

JP-6861790-B2, machine translation (Year: 2024).*

JP-2002090073-A machine translation (Year: 2024).*

DE-102017104727-A1 machine translation (Year: 2024).*

United States Patent and Trademark Office; Non-Final Office Action issued in U.S. Appl. No. 17/039,701, 19 pages, dated Mar. 3, 2022. Transmittal of Related Applications dated Apr. 11, 2022.

United States Patent and Trademark Office; Final Office Action issued in U.S. Appl. No. 17/039,701, 61 pages, dated Dec. 9, 2022.

Gaye, Samba, United States Patent and Trademark Office, Notice of Allowance issued in U.S. Appl. No. 17/039,701, 24 pages, dated May 3, 2023.

United States Patent and Trademark Office; Notice of Allowance issued in U.S. Appl. No. 17/039,701, 21 pages, dated Mar. 7, 2023.

Gaye, Samba, United States Patent and Trademark Office, Non-Final Office Action issued in U.S. Appl. No. 18/191,796, 140 pages, dated Mar. 12, 2025.

* cited by examiner

REFRIGERATOR WITH A THERMALLY CONDUCTIVE COMPONENT WITH HEATER FOR ICE MAKER

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an ice making and dispensing system. Ice makers typically include a mold body with either metal or plastic ice trays, where water may be shaped and frozen. Once the water is frozen in the trays, a heater may be used to melt the surfaces of the ice in contact with the trays to facilitate release of the ice from the trays, e.g., using a rake or by inverting the mold body. Typically, a "U"-shaped calrod heater may be utilized, and may be held in place (e.g. by a tab) on the periphery of the ice maker. The calrod heater is conventionally not in direct contact with the ice trays, but rather mounted at either the bottom of the ice maker mold or on the top of the icemaker mold. The heat generated by the calrod heater then travels through the mold body to warm the ice trays in order to release the ice.

These calrod heaters are on anytime they are energized, and as such, they cannot be precisely controlled. They may also require a lengthy warm up and/or cool down period. As such, there exists a need in the art for ice makers that may be able to more precisely control the heating in order to facilitate faster harvesting of the ice.

SUMMARY

The herein-described embodiments address these and other problems associated with the art by providing a refrigerator that utilizes an ice maker with a thermally conductive component, such as a busbar, with a heater(s).

Therefore, consistent with one aspect of the invention, a refrigerator, includes: a cabinet including one or more food compartments and one or more doors closing the one or more food compartments; an ice maker located in the cabinet to produce ice, where the ice maker includes: a mold body for forming ice including a plurality of cups, where each cup has an opening in which water may be frozen; a thermally conductive component located near a bottom surface of the cups; a heater(s) coupled with the thermally conductive component, where the heater(s) provide heat to the cups and the thermally conductive component distributes heat and thereby facilitates release of ice from the cups.

In some embodiments, the thermally conductive component includes a channel along an axis parallel to the plurality of cups, the channel configured to receive the at least one heater. In some such embodiments, the heat(s) is a calrod heater. In other such embodiments, the thermally conductive component is a singular piece formed by extrusion.

In some embodiments, the thermally conductive component includes a top surface disposed proximate the plurality of cups and a bottom surface, where the bottom surface is flat and the at least one heater is coupled to the bottom surface.

In some embodiments, the heaters are ceramic heaters that are located near the bottom surface of the thermally conductive components.

In some embodiments, the thermally conductive component includes: a top surface located near a lower surface of the cups along an axis substantially parallel to the cups; a protrusion extending away from the top surface towards the cups approximately perpendicular to the top surface, where the protrusion is located between a first cup of the cups and a second cup of the cups; and where the at least one heater is coupled to the bottom surface.

In some such embodiments, the protrusion is a first protrusion, and there is a plurality of protrusions, where one of the plurality of protrusions is between each of the cups. In some such instances, the at least one heater is a plurality of ceramic heaters, where the plurality of ceramic heaters is arranged so that each of the ceramic heaters heats the first cup and the second cup of the cups.

In some embodiments, each cup is constructed of metal and the mold body is constructed of plastic. In other embodiments, each cup is constructed of a plastic material with a metallic coating.

In some embodiments, the ice maker further includes a temperature sensor; and a controller coupled to the ice maker to control, based on a signal from the temperature sensor, one or more of the plurality of heaters.

In another aspect, an ice maker, includes: a mold body for forming ice, the mold body including cups, each of which having an opening for receiving water to be frozen within the cup; at least one heater; a thermally conductive component that includes a top surface located near a bottom surface of the cups and a bottom surface; where the bottom surface is flat and the at least one heater is coupled to the bottom surface; where the at least one heater provides heat to the cups; and where the thermally conductive component distributes heat and facilitates a release of ice from the cups.

In some embodiments, the at least one heater is a plurality of ceramic heaters, where the plurality of ceramic heaters is arranged so that each of the ceramic heaters heats a first cup and a second cup.

In some embodiments, the thermally conductive component further includes a protrusion extending away from the top surface towards the plurality of cups approximately perpendicular to the top surface; and where the protrusion is located between a first cup of the plurality of cups and a second cup of the plurality of cups. In some such embodiments, the protrusion is a first protrusion of multiple protrusions, where one of the plurality of protrusions is between each of the cups.

In yet another aspect, an ice maker, includes: a mold body for forming ice, the mold body including a plurality of cups, each cup having an opening for receiving water to be frozen within the cup; at least one heater; a thermally conductive component that includes: a surface located near a bottom surface of the cups; a channel along an axis parallel to the plurality of cups, the channel receives the at least one heater; where the at least one heater provides heat to the cups; and where the thermally conductive component distributes heat and facilitates a release of ice from the cups.

In some embodiments, the at least one heater is a calrod heater. In some embodiments, the ice maker further includes: a protrusion extending towards the cups approximately perpendicular to the surface, where the protrusion is located between a first cup and a second cup; and where the at least one heater is coupled to the bottom surface.

In some embodiments, the protrusion is a first protrusion, and there is a plurality of protrusions, where each of the plurality of protrusions is between each of the plurality of cups.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

FIG. 3A is a perspective view of the ice maker with thermally conductive component with heater; FIG. 3B is an exploded view of the ice maker of FIG. 3A.

FIG. 4A is perspective view of additional embodiment of the thermally conductive component; FIG. 4B is also perspective view of additional embodiment of the thermally conductive component.

FIG. 6A is an exploded view of the exemplary ice maker; FIG. 6B is a perspective view of another embodiment of the thermally conductive component of the ice maker of FIG. 6A.

DETAILED DESCRIPTION

Figure 1:
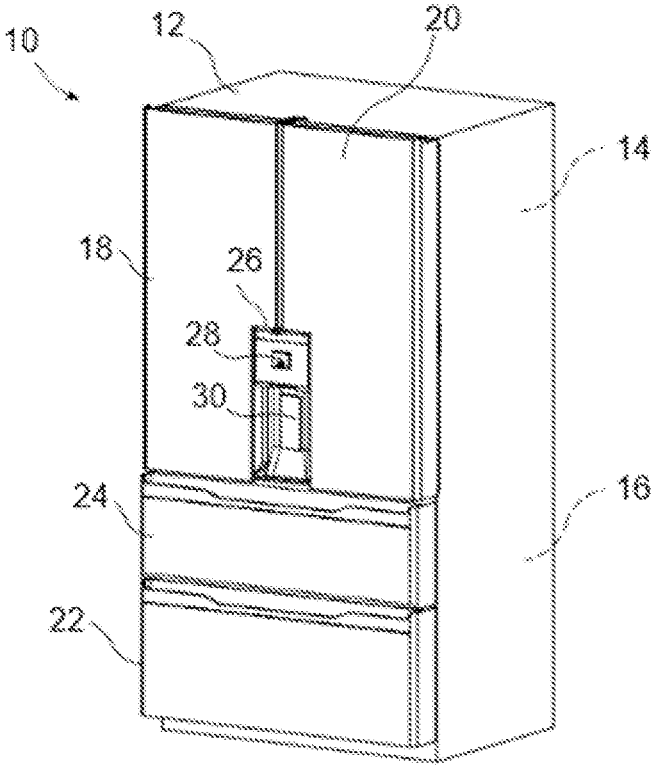
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a single sliding freezer compartment door 22 that is similar to a drawer and that pulls out to provide access to items in the freezer compartment. It will be appreciated, however, that other door designs may be used in other embodiments, including various combinations and numbers of hinged and/or sliding doors for each of the fresh food and freezer compartments. Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments.

Refrigerator 10 also includes a door-mounted dispenser 24 for dispensing ice and/or a fluid such as water. In the illustrated embodiments, dispenser 24 is an ice and water dispenser capable of dispensing both ice (cubed and/or crushed) and chilled water, while in other embodiments, dispenser 24 may be an ice only dispenser for dispensing only cubed and/or crushed ice. In still other embodiments, dispenser 24 may dispense hot water, coffee, beverages, or other fluids, and may have variable and/or fast dispense capabilities, as well as an ability to dispense predetermined or measured quantities of fluids. In some instances, ice and water may be dispensed from the same location, while in other instances separate locations may be provided in the dispenser for dispensing ice and water.

Refrigerator 10 also includes a control panel 26, which in the illustrated embodiment is integrated with dispenser 24 on door 18, and which includes various input/output controls such as buttons, indicator lights, alphanumeric displays, dot matrix displays, touch-sensitive displays, etc. for interacting with a user. In other embodiments, control panel 26 may be separate from dispenser 24 (e.g., on a different door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Figure 2:
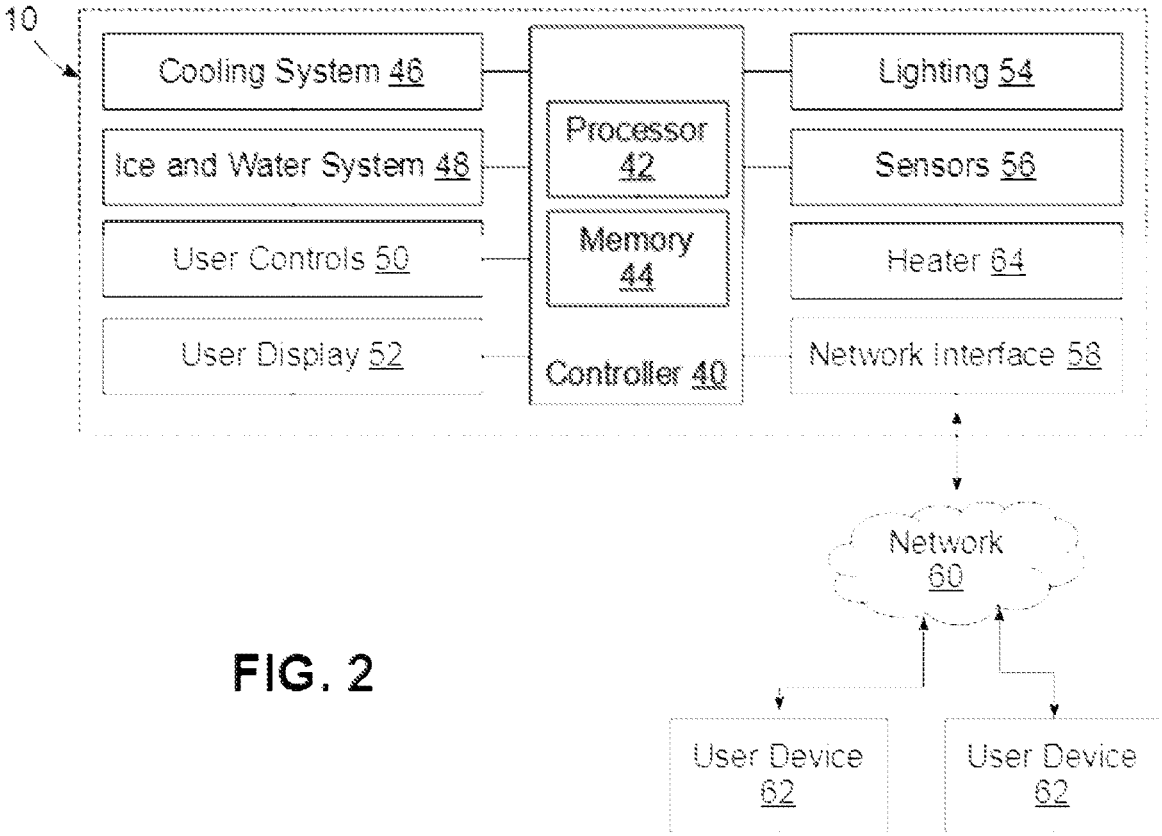
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator. Further, in some embodiments, audio feedback may be provided to a user via one or more speakers; and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. For example, sensors may include temperature sensors within an icemaker, as well as temperature sensors within the fresh food and/or freezer compartments 14, 16. Sensors 56 may also include additional types of sensors such as door switches, switches that sense when a portion of an ice dispenser has been removed, and other status sensors. Controller 40 may also be interfaced with one or more heaters 64 of an ice making system as described herein.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Thermally Conductive Component with Heater for Ice Maker

In the embodiments discussed hereinafter, a refrigerator may include an ice maker with a thermally conductive component, such as a busbar and/or thermal busbar, that includes a heater(s) for facilitating the removal of ice. For example, such an ice maker, as will be described and illustrated herein, may include a mold body with multiple cups for forming ice. Each of these cups incudes an opening to receive water to be frozen. The mold body may additionally include a thermally conductive component on or in which one or more heaters may be disposed to allow to efficiently dissipating heat.

Figure 3A:
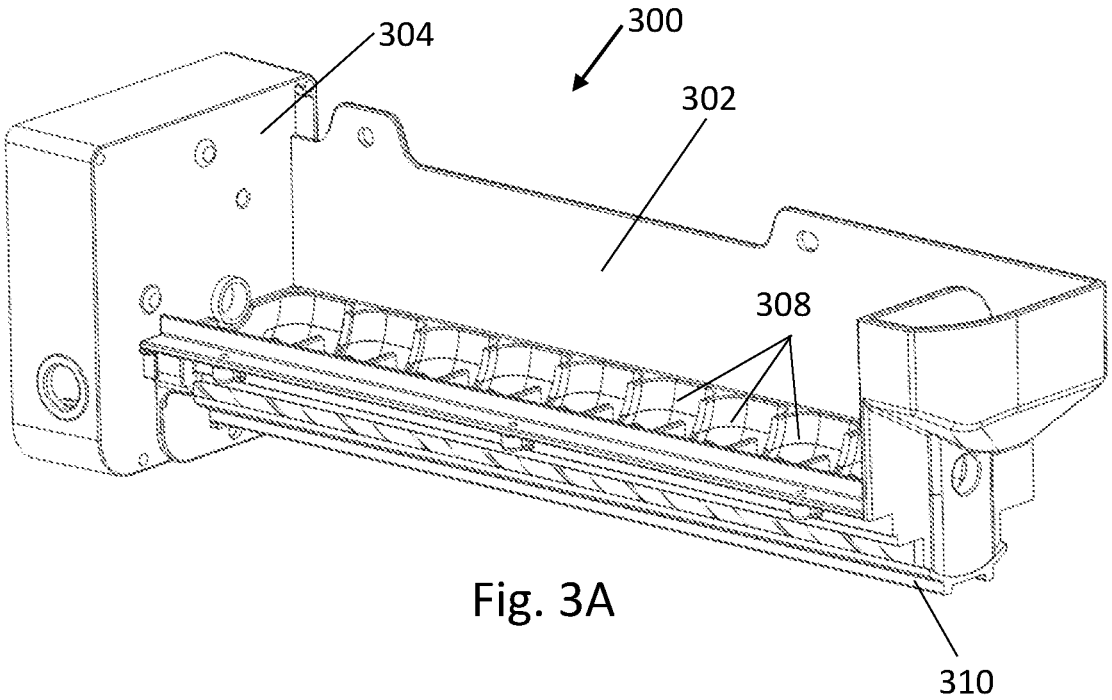
FIGS. 3A-B illustrate an exemplary ice maker with thermally conductive component with heater consistent with some embodiments of the invention.
Figure 3B:
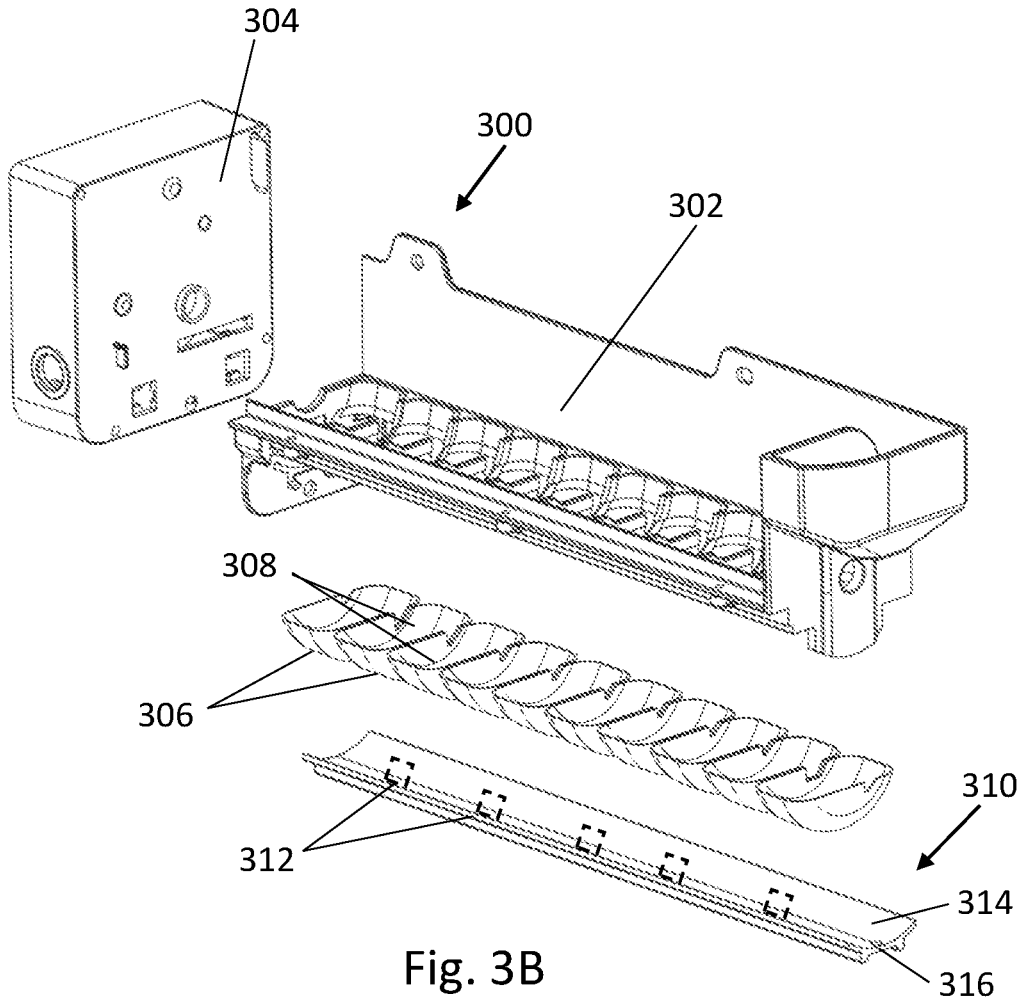

Now turning to FIGS. 3A-B, an exemplary ice maker 300 is illustrated. In some instances, such as illustrated, the ice maker 300 includes a mold body 302, which may further contain the cups 308 that form the ice. The ice maker 300 also includes a motor inside of a housing 304 that is configured to drive a rake (not illustrated) for harvesting the ice. In some instances, the cups 308 may be integrated into the mold body 302; while in other instances, the cups 308 may be constructed separately from the mold body 302. These cups 308 receive water and form the ice, and as such, resulting ice will reflect the shape of the cups 308. The shape and design of the cup may vary based on the desired shape and design of the resulting ice. In some instances, these cups 308 may be formed, for example via stamping, of stainless steel, which may be desired for its corrosion resistance and longevity. In other instances, these cups 308 may be formed, for example, of another thermally conductive material, such as copper. In such instances, the mold body 302 may be formed of a plastic, and the cups 308 may be stamped with the thermally conductive material; however, these materials are not intended to be limiting. In still other embodiments, the mold body 302 may be constructed of a plastic material, and the cups 308 may be dipped or coated in a thermally conductive metal or a physical vapor deposition (PVD) coating. In typical ice makers, the majority of the mold body is utilized to house the heater, for example a calrod heater, and to conduct heat towards the cups. As discussed in detail herein, the ice maker 300 includes a thermally conductive component 310 with one or more heaters 312 for distributing heat to the cups 308.

The exemplary ice maker 300 illustrated in FIGS. 3A-B includes a thermally conductive component 310 with a top surface 314 that may be disposed proximate to or in contact with a bottom surface 306 of the cups 308, and a flat or substantially flat bottom surface 316. In some instances, the thermally conductive component 310 may be constructed of a thermally conductive metal, for example aluminum, copper, steel, stainless steel, or the like. In some instances, such as illustrated herein, the thermally conductive component 310 may be in the form of a busbar, but this is not intended to be limiting. The top surface 314 of thermally conductive component 310 may be attached, for example thermally and/or mechanically, to the cups 308. Attaching the thermally conductive component 310 to the bottom surface 306 of the cups 308 may allow for heat to be efficiently distributed to the cups 308 where it is needed. In some instances, a thermal compound may be used between the cup and the thermally conductive component. This is in contrast to conventional designs, where heat often has to travel through a lengthy and treacherous path to reach the cup area.

In some instances, such as the embodiment illustrated in FIGS. 3A-B, the metal thermally conductive component 310 may be formed via stamping. One or more heaters 312 may then be coupled to the thermally conductive component 310. These heaters may be utilized in order to produce heat and facilitate the melting of a surface of the ice in contact with the cup 308 in preparation for harvesting the ice. The stamped thermally conductive component 310 of FIGS. 3A-B may include a flat or substantially flat bottom 316, onto which one or more heaters 312 may be coupled. In some instances, the one or more heaters 312 may be one or more ceramic heaters thermally and/or mechanically attached to the thermally conductive component 310. Although described herein as a thermally conductive component, it is to be understood that this is not limited to a single component and that the thermally conductive component may be a collection of multiple thermally components together.

Figure 4A:
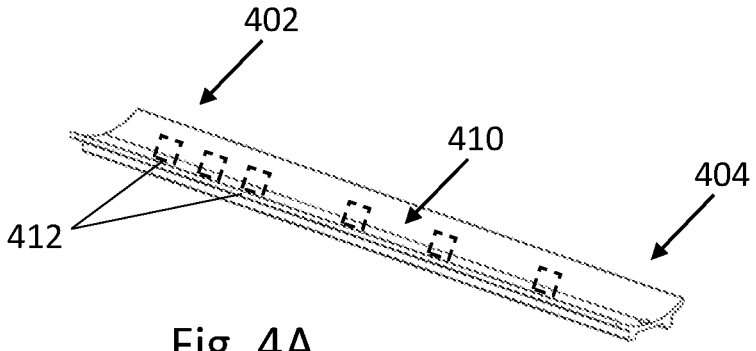
FIGS. 4A-B illustrate further examples of the thermally conductive component of the ice maker of FIGS. 3A-B consistent with some embodiments of the invention.
Figure 4B:
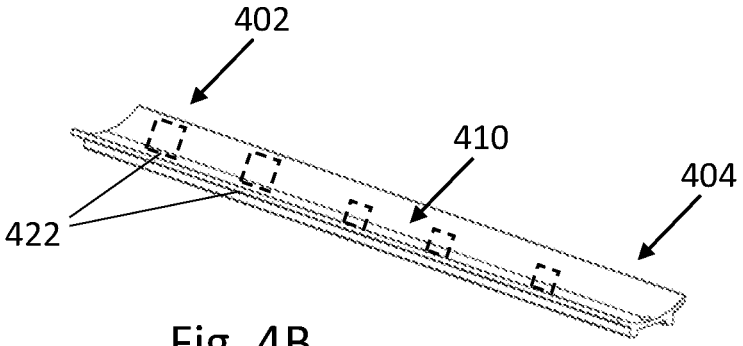

In some instances, there may be a temperature gradient along ice makers such that one end of the ice maker is cooler than the other end; conventional ice makers do not allow for precision heating solutions to address such gradients. However, in an ice maker 300 with a thermally conductive component 310, the number, position, and/or wattage of heaters 312 may be varied to address this gradient or imbalance. Referring now to FIG. 4A, an example of such and imbalance is illustrated, where a first end 402 of the thermally conductive component 410 is in a cooler environment than a second end 404. In this embodiment, there may be an increased number of heaters 412 coupled to the thermally conductive component 410 proximate the cooler, first end 402. Similarly, the heaters 412 disposed proximate the cooler, first end 402 may be placed in closer proximity than those at the warmer, second end 404 with multiple heaters 412 is illustrated. FIG. 4B, illustrates another example of addressing such and imbalance. Similar to FIG. 4A, the first end of the thermally conductive component 402 is cooler than the second end 404. In this embodiment, the heaters 422 disposed proximate the thermally conductive component 410 at the cooler, first end 402 have a higher wattage than the heaters 422 disposed proximate the warmer, second end 404. Although the higher wattage heaters are depicted as larger in FIG. 4B, this is not intended to be limiting as the increase in size is merely illustrative of the higher wattage. In other instances, a combination of the placement, number, and/or variation in the wattage of the heaters may be used to achieve the desired balance of heating.

In still other instances, the thermally conductive component may have a variable cross section in order to distribute heat more efficiently to all of the cups. In such an embodiment, the thickness of the flat or substantially flat bottom surface (see 316 in FIGS. 3A-B) of the thermally conductive component may vary. For example, where a first end of the thermally conductive component is in a cooler region the thermally conductive component may be thinner to allow for heat to dissipate more quickly. Likewise, where a second end of the thermally conductive component is in warmer region the thermally conductive component may be thicker to allow for heat to dissipate more slowly.

Figure 5:
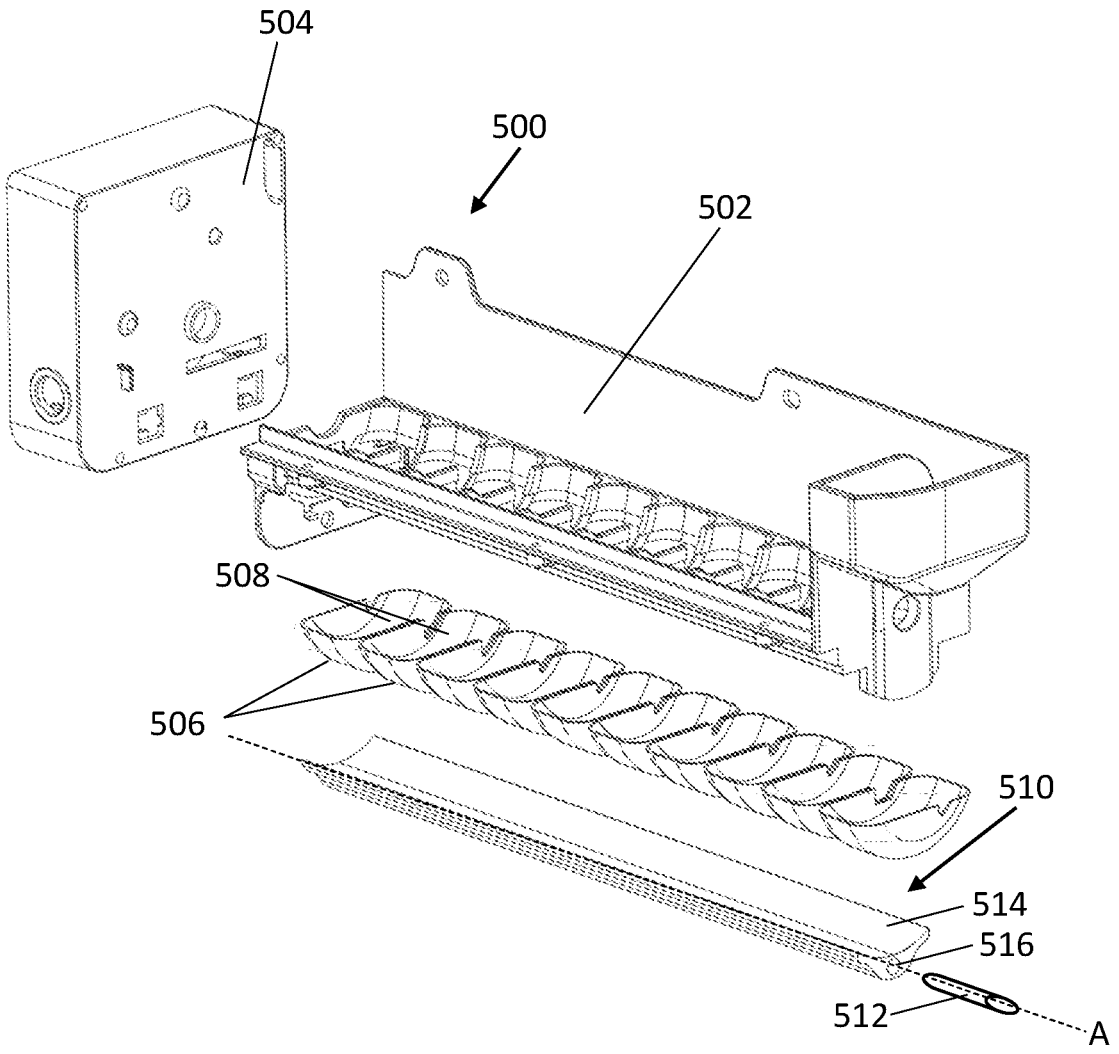
FIG. 5 is an exploded view of another exemplary ice maker with thermally conductive component with heater consistent with some embodiments of the invention.

Now turning to FIG. 5, another exemplary ice maker 500 is illustrated. Similar to the previously illustrated embodiment, the ice maker 500 includes a motor enclosed in housing 504 and a mold body 502, which may further contain the cups 508 that form the ice. The ice maker 500 further includes a thermally conductive component 510 with a heater 512 for distributing heat to the cups 508. Also similar to other embodiments discussed herein, the thermally conductive component 510 may be constructed of a thermally conductive material, such as aluminum, copper, or the like. In some instances, such as illustrated herein, the thermally conductive component 510 may be in the form of a busbar, but this is not intended to be limiting. The thermally conductive component 510 in the embodiment illustrated in FIG. 5 includes a top surface 514 that may be disposed proximate to or in contact with a bottom surface 506 of the cups 508. In some instances, the metal thermally conductive component 510 may be extruded, and in some instances extruded as a single piece. This may allow the thermally conductive component 510 to include one or more channels 516 or pockets in which the one more heaters 512 may be disposed. These channels 516 or pockets may protect the heaters from damage. In the example illustrated in FIG. 5, a channel 516 may run through the thermally conductive component 510 along an axis A that is substantially parallel to the bottom surface 506 of the cups 508. A heater 512, for example a calrod heater, may be placed within the channel 516. The calrod heater 512 illustrated in FIG. 5 is not intended to be limiting. In some instances, the calrod heater 512 may be approximately the same length as the thermally conductive component 510, and thus run substantially the entire length of the thermally conductive component 510; in other instances, the calrod heater 512 may be shorter in length than the thermally conductive component 510. In still instances, there may be more than one calrod heater disposed within the channel 516, including as a non-limiting example one disposed proximate each end of the thermal conductive component 510. In some such instances where there are multiple calrods, the calrods may be of varying wattages as described above. For example, the calrod disposed proximate the cooler end of the ice maker may be a higher wattage than the calrod disposed at the warmer end of ice maker.

In another instance, the metal thermally conductive component may be extruded with multiple pockets in which the ceramic heaters described with reference to FIGS. 3A-B and 4A-B may be disposed, rather than being placed on a bottom surface of the thermally conductive component. In some instances, these pockets may be fully enclosed; while in other instances, these pockets may be open to the bottom of the thermally conductive component that still hold the heater in place. This may, in some instances, provide additional protection to the ceramic heaters.

Figure 6A:
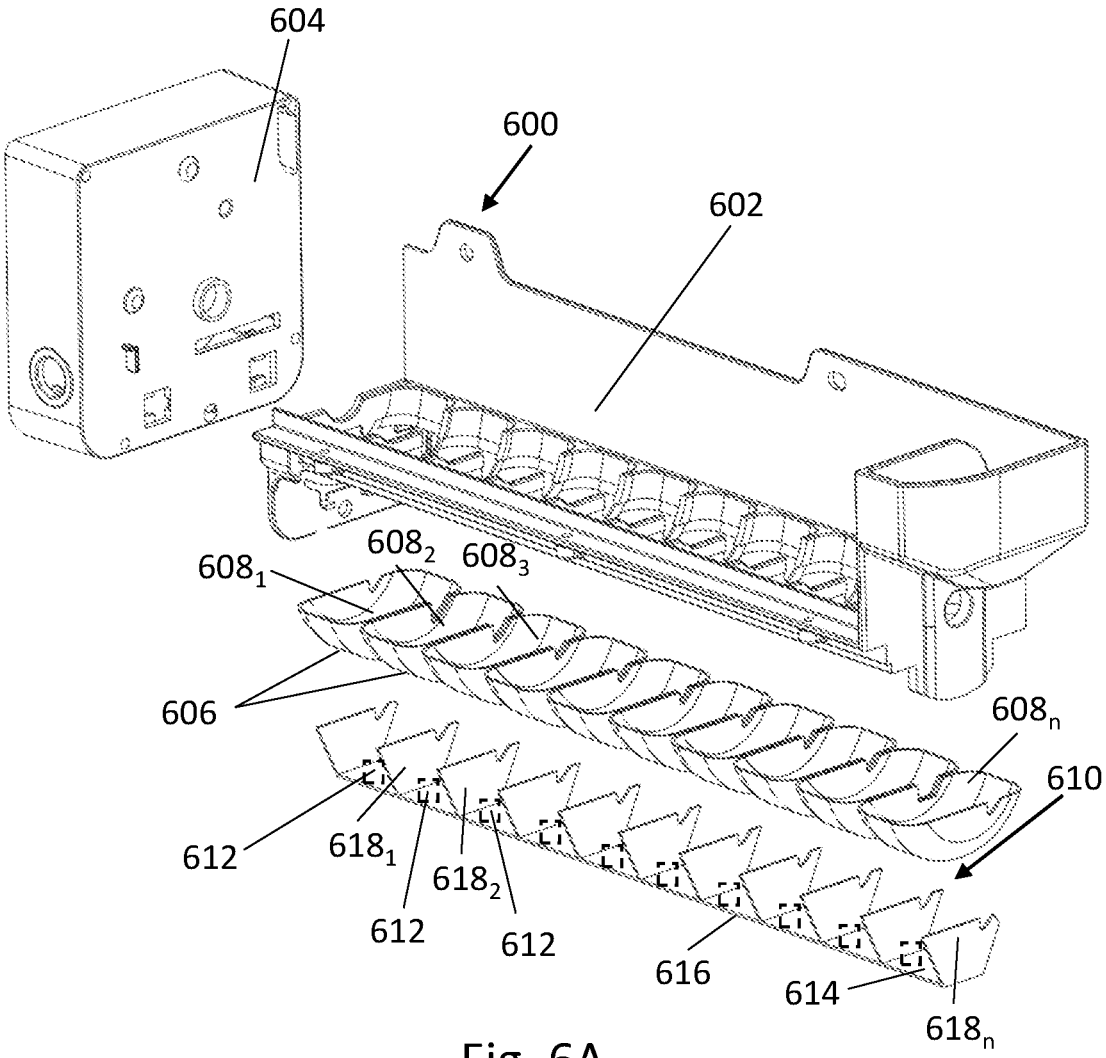
FIGS. 6A-B illustrate another exemplary ice maker with thermally conductive component with heater consistent with some embodiments of the invention.
Figure 6B:
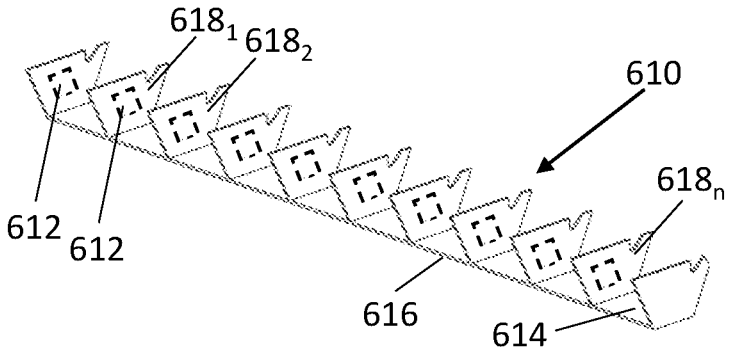

Yet another exemplary ice maker 600 is illustrated in FIGS. 6A-B. Similar to previous embodiments, the ice maker 600 includes a motor in a housing 604, a mold body 602, cups 608, and thermally conductive component 610 with one or more heaters 612 for distributing heat to the cups $\mathbf{608}_{1\text{-}N}$. The thermally conductive component 610 in the embodiment illustrated in FIGS. 6A-B includes a top surface 614 that may be disposed proximate to or in contact with the bottom surface 606 of the cups 608. The thermally conductive component 610 may further include one or more protrusions 618 extending approximately perpendicular to the top surface 614, so that the protrusion may be disposed between a first cup $\mathbf{608}_1$ and a second cup $\mathbf{608}_2$. These protrusions 618 may be constructed of any thermally conductive material, such an aluminum, copper, or the like. In some instances, the protrusions $\mathbf{618}_{1\text{-}N}$ are constructed of the same thermally conductive material as the other portions thermally conductive component 610, but this is not intended to be limiting. In other instances, the protrusions $\mathbf{618}_{1\text{-}N}$ may be formed integrally, for example through extrusion, with the thermally conductive component 610. This is also not intended to be limiting, as in other instances, the protrusion $\mathbf{618}_{1\text{-}N}$ may also be separately produced and mechanically combined with the thermally conductive component 610.

In some instances, such as illustrated in FIG. 6A, the one or more heaters may be disposed on a bottom surface 616 of the thermally conductive component 610. Although illustrated in FIG. 6A as having the number of heaters 612 corresponding to the number of cups 608, this is not intended to be limiting. In some instances, there may only be a single heater 612 for every two or three cups 608. For example, where there may be a single heater 612 for every two cups (e.g. $\mathbf{608}_1$ and $\mathbf{608}_2$) the heater 612 may be disposed proximate the junction of the protrusion $\mathbf{618}_1$ between the first cup $\mathbf{608}_1$ and second cup $\mathbf{608}_2$, and the thermally conductive component 610. As another example, where there may be a single heater 612 for every three cups (e.g. $\mathbf{608}_1$, $\mathbf{608}_2$, and $\mathbf{608}_3$) the heater 612 may be disposed proximate the middle cup, in this example $\mathbf{608}_2$.

In other instances, such as illustrated in FIG. 6B, the one or more heaters 612 may be coupled to or disposed in a pocket of (as described above with reference to FIG. 5) one or more protrusions 618, so that the heaters may be located in between the cups 608. Although illustrated in FIG. 6B as having number of heaters 612 corresponding to the number of cups 608, this is not intended to be limiting. The number of heaters may vary. In some instances, the heaters 612, regardless of their positioning, may be ceramic heaters.

As described previously, there may be a temperature gradient along ice makers such that one end of the ice maker may be cooler than the other end. Similar to the ice maker described with reference to FIGS. 3A-B and 4A-B, the thermally conductive component 610 of ice maker 600 illustrated in FIGS. 6A-B may vary the number, position, and/or wattage of heaters 612 in order to address this gradient or imbalance.

Figure 7:
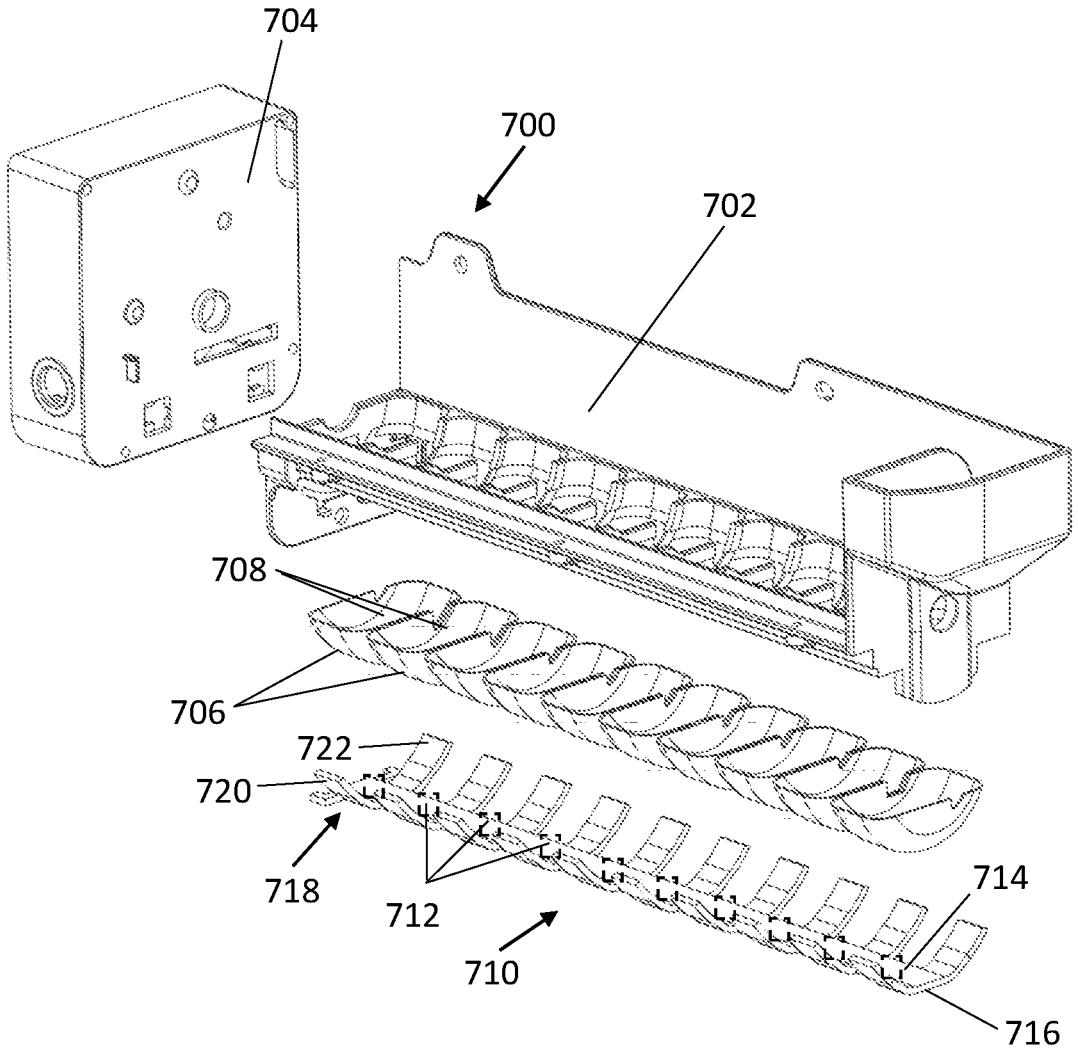
FIG. 7 is an exploded view of another exemplary ice maker with thermally conductive component with heater consistent with some embodiments of the invention.

Yet another exemplary ice maker 700 is illustrated in FIG. 7. Similar to previous embodiments, the ice maker 700 includes a motor 704, a mold body 702, cups 708, and thermally conductive component 710 with one or more heaters 712 for distributing heat to the cups 708. The thermally conductive component 710 in the embodiment illustrated in FIG. 7 includes a top surface 714 that may be disposed proximate to or in contact with the bottom surface 706 of the cups 708. The thermally conductive component 710 may further include one or more arcuate protrusions 718 extending away from the top surface 714 toward the cups 708 in an arcuate or curved manner, such that the curvature of the one or more arcuate protrusions 718 is similar to the curvature of the cups 708. As a non-limiting example, the radius of the curvature of the one or more arcuate protrusions 718 illustrated in FIG. 7 is approximately one inch or 25 mm. This is not to be understood as limiting, as the radius of the curvature for the arcuate protrusions may vary based on the curvature of the cups.

These arcuate protrusions 718 may be constructed of any thermally conductive material, such an aluminum, copper, or the like. In some instances, the arcuate protrusions 718 may be constructed of the same thermally conductive material as the other portions thermally conductive component 710. In some instances, the arcuate protrusions 718 may be formed integrally, for example through extrusion or stamping, with the remainder of the thermally conductive component 710; but this is also not intended to be limiting, as the arcuate protrusions 718 may also be separately produced and mechanically combined with the thermally conductive component 710.

In some instances, such as illustrated in FIG. 7, each of the arcuate protrusions 718 may include a first arcuate portion 720 and a second arcuate portion 722 extending away from the top surface 714 towards a cup 708 in opposing directions from the top surface 714 of the thermally conductive component 710 towards the cups 708, so as to cradle or envelop the corresponding cup 708 on each side. In other instances, the arcuate protrusion 718 may extend towards the cups 708 only on a first side of a cup 708.

In some instances, such as illustrated in FIG. 7, the one or more heaters may be disposed on a bottom surface 716 of the thermally conductive component 710. The number of heaters 712 may correspond to the number of cups 708, but this is not intended to be limiting. In some instances, there may only be a single heater 712 for every two or three cups 708. In other instances, the one or more heaters may be coupled to or disposed in a pocket of (as described above with reference to FIG. 5) one or more arcuate protrusions 718 so that the heat may be closer to the cups 708, which may result in more efficient heat distribution. In some instances, the heaters 712, regardless of their positioning, may be ceramic heaters.

Any of the ice makers with thermally conductive components and one or more heaters described herein may be utilized in an ice maker with a one-piece mold design (which is a design style that is widely available in the market). Alternatively, the ice makers described herein may be utilized in an over molded ice maker design, where the cups or ice cube cavities are held together by an over molded plastic body.

In some instances, the heaters described herein (e.g. 312, 412, 422, 512, 612, and 712) may be interfaced with a controller (for example controller 40 of FIG. 2), which may allow for control of the heater(s). In other instances, there may be adjacent one or more of the cups described here (e.g. 308, 508, 608, and 708) may be one or more temperature sensors (not illustrated, see e.g. sensor 56), which may also be interfaced with a controller (for example controller 40 of FIG. 2).

Other variations will be apparent by those of ordinary skill having the benefit of the instant disclosure. It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including one or more food compartments and one or more doors closing the one or more food compartments;

an ice maker disposed in the cabinet to produce ice, the ice maker including:

a mold body for forming ice, the mold body including a plurality of cups, each cup having an opening for receiving water to be frozen within the cup;

a thermally conductive component constructed of a thermally conductive metal and that includes:

an arcuate top surface disposed proximate the plurality of cups; and a flat bottom surface;

a plurality of discrete ceramic heaters distinct from the thermally conductive component and coupled to the flat bottom surface of the thermally conductive component along an axis substantially parallel to the plurality of cups;

wherein the plurality of discrete ceramic heaters is configured to provide heat to the plurality of cups; and wherein the thermally conductive component is configured to distribute heat from the plurality of discrete ceramic heaters such that heat provided from a first discrete ceramic heater of the plurality of discrete ceramic heaters provides heat to at least two of the plurality of cups and thereby facilitates a release of ice from the plurality of cups.

2. The refrigerator of claim 1, wherein the thermally conductive component includes an opening extending longitudinally through the thermally conductive component along an axis parallel to the plurality of cups, the opening configured to receive at least one of the plurality of discrete ceramic heaters.

3. The refrigerator of claim 2, wherein one of the plurality of discrete ceramic heaters is a calrod heater.

4. The refrigerator of claim 2, wherein the thermally conductive component is a singular extruded piece.

5. The refrigerator of claim 1, wherein the thermally conductive component includes:

a protrusion extending away from the top surface towards the plurality of cups approximately perpendicular to the top surface, wherein the protrusion is disposed between a first cup of the plurality of cups and a second cup of the plurality of cups.

6. The refrigerator of claim 5, wherein the protrusion is a first protrusion, and there is a plurality of protrusions, wherein one of the plurality of protrusions is between each of the plurality of cups.

7. The refrigerator of claim 1, wherein each cup of the plurality of cups is constructed of metal and the mold body is constructed of plastic.

8. The refrigerator of claim 1, wherein each cup of the plurality of cups is constructed of a plastic material with a metallic coating.

9. The refrigerator of claim 1, wherein the ice maker further comprises a temperature sensor, and the refrigerator further comprises a controller coupled to the ice maker configured to control, based on a signal from the temperature sensor, the at least discrete one heater.

10. The refrigerator of claim 1, wherein each of the plurality of discrete ceramic heaters is positioned on the bottom surface of the thermally conductive component according to a temperature gradient of the ice maker.

11. The refrigerator of claim 1, wherein a wattage of each of the plurality of discrete ceramic heaters is varied according to a temperature gradient of the ice maker.

12. The refrigerator of claim 1, wherein the ice maker includes a temperature gradient from a first end of the ice maker to a second end of the ice maker and wherein the thermally conductive component and the plurality of discrete ceramic heaters are configured to non-uniformly distribute heat to the plurality of cups.

13. The refrigerator of claim 12, wherein the plurality of discrete heaters are positioned on the thermally conductive component to compensate for the temperature gradient from the first end to the second end of the ice maker.

14. The refrigerator of claim 12, wherein output levels of the plurality of discrete heaters are configured to compensate for the temperature gradient from the first end to the second end of the ice maker.

15. The refrigerator of claim 12, wherein the thermally conductive component has a variable cross section such that a first end of the thermally conductive component is thicker than a second end of the thermally conductive component to compensate for the temperature gradient from the first end to the second end of the ice maker.

16. An ice maker, comprising:

a mold body for forming ice, the mold body including a plurality of cups, each cup having an opening for receiving water to be frozen within the cup;

a plurality of heaters;

a thermally conductive component that includes:

an arcuate top surface disposed proximate a bottom surface of the plurality of cups; and a flat bottom surface;

wherein the plurality of heaters is distinct from the thermally conductive component and is coupled to the flat bottom surface of the thermally conductive component along an axis substantially parallel to the plurality of cups;

wherein a first heater of the plurality of heaters is configured to provide heat to at least two of the plurality of cups; and wherein the thermally conductive component is configured to distribute heat from the plurality of heaters and thereby facilitate a release of ice from the plurality of cups.

17. The ice maker of claim 16, wherein the plurality of heaters is a plurality of ceramic heaters, wherein the plurality of ceramic heaters is arranged so that each of the plurality of ceramic heaters heats a first cup and a second cup of the plurality of cups.

18. The ice maker of claim 16, wherein the thermally conductive component further includes a protrusion extending away from the top surface towards the plurality of cups approximately perpendicular to the top surface; and wherein the protrusion is disposed between a first cup of the plurality of cups and a second cup of the plurality of cups.

19. The ice maker of claim 18, wherein the protrusion is a first protrusion, and there is a plurality of protrusions, wherein one of the plurality of protrusions is between each of the plurality of cups.

* * * * *